United States Patent [19]

Cook

[11] Patent Number: 4,922,776

[45] Date of Patent: May 8, 1990

[54] VARIABLE WIDTH SPLITTER

[75] Inventor: William G. Cook, Glens Falls, N.Y.

[73] Assignee: Sandy Hill Corporation, Hudson Falls, N.Y.

[21] Appl. No.: 202,470

[22] Filed: Jun. 6, 1988

[51] Int. Cl.[5] ..... B65H 19/26

[52] U.S. Cl. ..... 83/398; 83/477.2; 242/56 R

[58] Field of Search ..... 83/397, 398, 477.2, 83/544–546, 508.2, 508.3, 425, 425.2, 353, 614; 242/56 R

[56] References Cited

U.S. PATENT DOCUMENTS

| | | | |
|---|---|---|---|
| 3,805,652 | 4/1974 | Lalonde et al. | 83/169 |
| 3,986,419 | 10/1976 | Cleghorn | 83/477.2 X |
| 4,638,695 | 1/1987 | Striebig | 83/100 |

*Primary Examiner*—Douglas D. Watts
*Assistant Examiner*—Eugenia A. Jones
*Attorney, Agent, or Firm*—Ross, Ross & Flavin

[57] ABSTRACT

A dry end tail cutter for a papermaking machine comprises a slotted housing for accommodating the traverse of a cutter in a cross machine direction relative to the machine. A drive motor mounted on the housing drives a slot closing band around a pair of opposed pulley wheels. The slot closing bank is entrained around the pulley wheels and has its opposite free ends interengaged with a motor mount disposed within and slidable relative to the housing. A knife motor is carried by the motor mount and moves therewith. A rotary knife is driven by the knife motor. The band functions to close the slot forwardly and rearwardly of the knife as the motor mount and knife are traversed in the cross machine direction relative to the papermaking machine.

1 Claim, 1 Drawing Sheet

VARIABLE WIDTH SPLITTER

My invention is directed to an improved dry end tail cutter.

The tail is identified as a narrow strip of paper, usually inches in width, which is used to thread a paper web in a running paper machine, the tail being cut to facilitate the threading. Historically, tail cutting is an admittedly old procedure in the papermaking art.

Because of the normally narrow width of such a tail, it is agonizingly susceptible to breakage in the course of the threading.

Were the papermaking able to thread one or two sections of the machine at a time and then widen the web to its full width, he could reduce the risk of breaking a tail and could minimize the errors or upsets.

For years, tail cutting has been accomplished at the wet end exploiting a water jet strategically directed so as to break up the formation wherefor a narrow strip of the paper can then be pulled from the full web.

Obviously, in the case of a web once dried, such modus operandi has not been possible.

Now over the last few years, dating back to sometime following WWII, a knife blade traversing the machine has been known for use on a dry web, but with the advent of higher machine speeds and lighter weights, the use of such a knife has not proven satisfactory.

In the case of some equipment manufacturers, they have resorted to rotary saws or end mills, either system having proven unacceptable for reason of the unreasonable amounts of paper dust generated thereby.

Rotating knives traversing the width of the machine have been experimented with, also with less than satisfactory results, primarily in the areas of the knife and mounting mechanism interfering with the web and of the collection of paper and dust.

According to the present invention, a driven rotary knife is so supported as to allow the knife to traverse the machine width.

By placing my driving means for the rotatable knife within the support structure, I provide for its guidance in the cross machine direction by a slot within the structure, which slot is closable by means of a moving belt, the belt serving as the mechanism for driving the knife transversely of the machine, the mechanism being self-sealing with respect to the slot.

Figure 1:
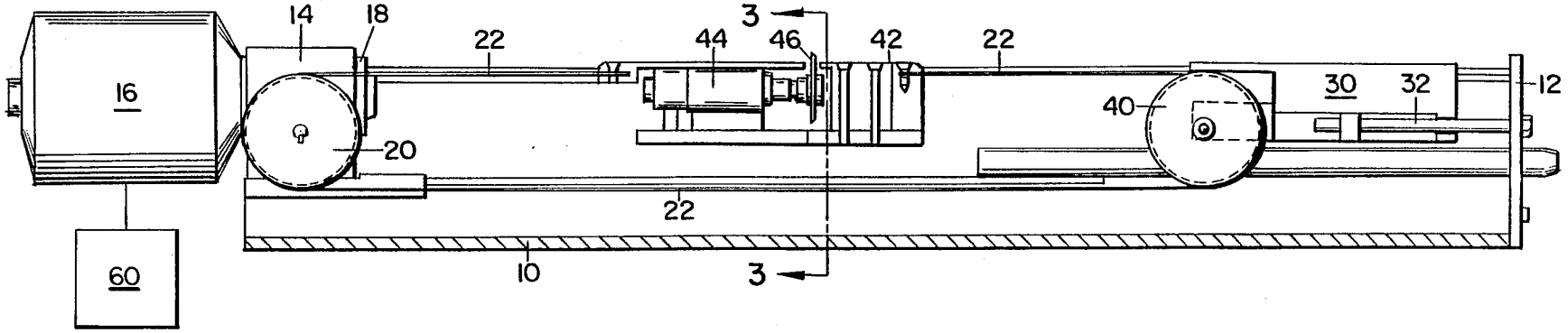
FIG. 1 is a view in side elevation showing the mechanism of the invention.
Figure 4:
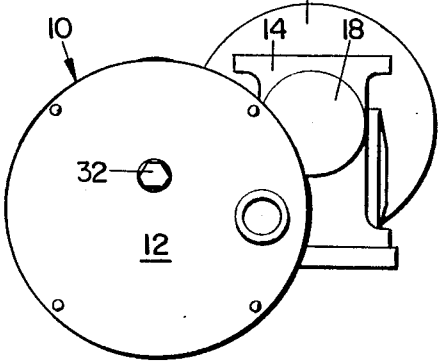
FIG. 4 is an enlarged end view taken from the right in FIG. 1.

A somewhat diagramatic view of the invention is shown in FIG. 1.

The supporting structure comprises a tube 10 closed at one end by an end wall 12 and provided at its opposite terminus with a bracket 14 secured thereto facilitating the mounting of a drive motor 16 outboard of the tube and associated gear reduction housing 18 by which a rotary motion is imparted to a pulley wheel 20 around which a steel band 22 is entrained.

At the opposite end of the tube and interiorly thereof, a bracket 30 is supported by means of a pintle 32 projecting inwardly from end plate 12, which bracket mounts a pulley wheel 40 around which steel band 22 is also entrained.

The opposite free ends of the steel band are secured to the respective opposite ends of a motor mount 42 which carries a rotary knife motor 44 which drives a rotary knife 46.

The top of the tube is slotted at 48 throughout its length and the cutting portion of the knife extends upwardly thereof and therethrough.

The motor mount has an uppermost portion which extends upwardly of and through the slot 48 sufficiently as to allow the steel band carried by the motor mount to fill the chord defined by the distance between the sides of the slot to be filled by the steel band.

The steel band, which is to be appreciated, serves not only to drive the knife motor and its knife transversely of the machine but also to seal the slot throughout its length, ergo the self closing feature of the band with reference to the slot, all whereby to deny entry of paper dust into the tube so as to interfere with the operating mechanism.

Figure 3:
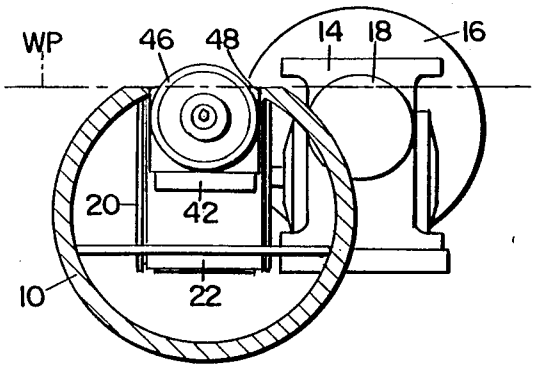
FIG. 3 is an enlarged view in section in the 3—3 line of FIG. 1.
Figure 2:
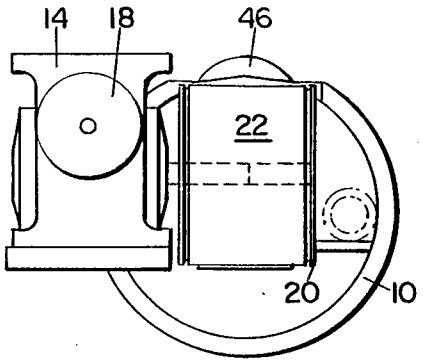
FIG. 2 is an enlarged end view taken from the left in FIG. 1, the motor being omitted.

The web path is indicated by WP in FIG. 3.

The mechanism can be otherwise defined as a motorized rotatable web cutting knife and movable transversely in a slot of a tube enclosing a means for sealing off the slot forwardly and rearwardly of the knife in the slot.

The mechanism may be provided with a programmable controller 60 with a memory for storing a desired operating sequence for responding to any desired change to be made in the width of the tail.

I claim:

1. Improvements in a mechanism to cut a tail from a paper web running through the dry end of a paper machine for facilitating the subsequent threading of the tail into a successive element of the machine, the mechanism being extendable along the machine width in a cross machine direction, the improvements comprising:

a cylindrical housing having an uppermost chord defining an elongated through-slot forming a path extendable along a major portion of the housing length and complemental to the width of the paper web being served, a pair of opposed pulleys rotatably mounted at opposite ends of and within the housing, a pulley drive motor supported by and exteriorly of the housing adjacent one of the pulleys for driving the same, a band entrained around the pulleys in upper and lower reach-defining segments with opposite free ends of the band having a space therebetween longitudinally aligned with the path of the upper reach, each part of the upper reach of the band having a sealed and guided relationship with the housing slot, a knife motor mount reciprocable within the housing with the opposite free ends of the band being secured to respective opposite ends of the mount for supporting the mount within the housing, a knife motor mounted on the knife motor mount, a rotary knife driven by the knife motor and having an uppermost cutting segment extendable upwardly through the housing slot for defining a cutting contact with the paper web running therepast, the band driving the knife motor mount and allowing the knife to selectively traverse the width of the paper web being served with variable portions of the housing slot inboard and outboard of the knife motor mount being closable by respective portions of the band as the band is reciprocated in the cross machine direction along the path defined by the housing slot responsively to the movement of the drive motor and the driven pulley.

* * * * *